US006517325B2

(12) United States Patent
Tsuru et al.

(10) Patent No.: US 6,517,325 B2
(45) Date of Patent: Feb. 11, 2003

(54) AIR COMPRESSOR AND METHOD OF OPERATING THE SAME

(75) Inventors: Seiji Tsuru, Tsuchiura (JP); Kazuki Takahashi, Tsuchiura (JP)

(73) Assignee: Hitachi, Ltd., Tokyo (JP)

( * ) Notice: Subject to any disclaimer, the term of this patent is extended or adjusted under 35 U.S.C. 154(b) by 0 days.

(21) Appl. No.: 09/779,856

(22) Filed: Feb. 9, 2001

(65) Prior Publication Data

US 2002/0001523 A1 Jan. 3, 2002

(30) Foreign Application Priority Data

Jun. 30, 2000 (JP) ..... 2000-203049

(51) Int. Cl.[7] ..... F04B 49/00

(52) U.S. Cl. ..... 417/298; 417/307; 417/440; 137/565.14

(58) Field of Search ..... 417/298, 307, 417/310, 440, 53; 137/565.14, 115.19

(56) References Cited

U.S. PATENT DOCUMENTS 3,049,284 A * 8/1962 Alamprese ..... 417/284
4,362,475 A * 12/1982 Seitz ..... 417/295
5,411,375 A * 5/1995 Bauer ..... 417/295
2002/0081213 A1 * 6/2002 Takahashi et al. ..... 417/244

FOREIGN PATENT DOCUMENTS

JP 55-51980 * 4/1980
JP 5-10285 * 1/1993
JP 7-286584 * 10/1995
JP 9-79166 * 3/1997

* cited by examiner

*Primary Examiner*—Charles G. Freay
*Assistant Examiner*—Michael K. Gray
(74) *Attorney, Agent, or Firm*—Antonelli, Terry, Stout & Kraus, LLP

(57) ABSTRACT

An air compressor comprises a compressor main body, and a capacity adjusting apparatus connected to an intake side of the compressor main body for adjusting the intake air flow into the compressor main body. The capacity adjusting apparatus is provided in an intake pipe. The intake pipe is adjacent to a discharge pipe of the compressor. A communicating passage is formed in the adjacent portion so as to introduce the compressed air discharged from the discharge pipe into the intake pipe system. The intake pipe is provided with an opening port for limiting the intake air flow into the compressor main body. The capacity adjusting apparatus opens and closes the communicating passage and the opening by means of an intake port switch valve and a discharge ventilating port switch valve which are provided in an end portion of the capacity adjusting apparatus.

10 Claims, 2 Drawing Sheets

AIR COMPRESSOR AND METHOD OF OPERATING THE SAME

BACKGROUND OF THE INVENTION

The present invention relates to an air compressor which is driven by switching a load operation and a no-load operation and a method of operating the air compressor, and more particularly to a screw type air compressor capable of adjusting the capacity thereof and a method of operating the screw type air compressor.

A conventional capacity adjusting apparatus of a air compressor is such that an intake passage and a discharge ventilating passage are independently provided, and valve bodies are provided in the respective passages, as described in JP-A-5-10285, for example. Further, in order to simultaneously operate these two valve bodies, a rack and pinion or the like is employed.

SUMMARY OF THE INVENTION

Since the apparatus described in JP-A-5-10285 mentioned above is provided with the intake passage and the discharge ventilating passage independently, so that the apparatus requires a large number of parts such as valve bodies, shafts supporting the valve bodies, shaft seals, bearings for the respective passages, and further requires pipes and silencer apparatus between the intake passage and an air take-in port and between the discharge ventilating passage and the air take-in port respectively, the apparatus has disadvantages such that the cost is increased and the reliability is deteriorated.

In view of the disadvantages in the prior art mentioned above, it is an object of the present invention to provide a screw type air compressor which is inexpensive and has high reliability. Another object of the present invention is to improve reliability of a capacity adjusting apparatus of a screw type air compressor so as to provide an air compressor having high reliability.

According to one aspect of the present invention, there is provided an air compressor comprising a compressor main body, an intake pipe connected to an intake side of the compressor main body and provided with a capacity adjusting apparatus for adjusting the flow of intake air flowing into the compressor main body, and a discharge pipe communicating with a discharge side of the compressor main body, wherein the intake pipe and the discharge pipe are adjacent to each other, a communicating passage is formed in the adjacent portion for introducing the compressed air from the discharge pipe into the intake pipe, an opening port is formed in the intake pipe for limiting the inflow of the intake air into the compressor main body, and the capacity adjusting apparatus comprises an opening and closing means for opening and closing the communicating passage and the opening port at one end portion of the opening and closing means.

In the air compressor mentioned above, the compressor main body may be a screw compressor comprising a male rotor and a female rotor, and/or the opening and closing means may comprise a shaft capable of reciprocating, an opening port switch valve and a communicating port switch valve mounted on one end side of the shaft.

According to further aspect of the present invention, there is provided a method of operating an air compressor comprising a compressor main body, and a capacity adjusting apparatus provided on an intake side of the compressor main body, the air compressor repeating a load operation and a no-load operation using the capacity adjusting apparatus so as to generate compressed air in accordance with the consumption of the compressed air, comprising the steps of:

(a) moving an opening and closing means provided in the capacity adjusting apparatus so as to introduce intake air into an intake side flow passage of the compressor main body and prevent the compressed air discharged from the compressor main body from flowing into the intake side flow passage during the load operation; and (b) moving the opening and closing means so as to prevent the intake air from flowing into the compressor main body and introduce the compressed air discharged from the compressor main body into the intake side flow passage during the no-load operation.

The method of operating an air compressor mentioned above may further comprise the steps of:

(c) driving the compressor main body by means of an inverter so as to control the rotational speed during the load operation, and (d) switching the load operation to the no-load operation when the rotational speed of the compressor main body is reduced to a predetermined lower limit value during the load operation.

According to another aspect of the present invention, there is provided a method of operating an air compressor comprising a compressor main body and a capacity adjusting apparatus, wherein the on-off actions for intake air flowing into the compressor main body and discharge air discharged from the compressor main body are controlled substantially at the same for switching a load operation and a no-load operation of the air compressor, comprising the steps of:

(a) turning off the discharge air flowing into an intake side and turning on the intake air flowing into the compressor main body by means of a capacity control apparatus during the load operation, and (b) turning on the discharge air flowing into the intake side and turning off the intake air flowing into the compressor main body by means of the capacity control apparatus during the no-load operation.

According to still another aspect of the present invention, there is provided an air compressor comprising a capacity adjusting apparatus provided on an intake side thereof, which repeats a load operation and a no-load operation, the capacity adjusting apparatus being provided with an intake port and a discharge ventilating port, the intake port being opened during the load operation and closed during the no-load operation, the discharge ventilating port being closed during the load operation and opened during the no-load operation, wherein the capacity adjusting apparatus comprises a first valve body for opening and closing the intake port and a second valve body for opening and closing the discharge ventilating port, the first valve body and the second valve body are arranged on a integral shaft, and a communicating portion is provided for connecting an intake passage provided on the intake side of the air compressor and a discharge ventilating passage provided on a discharge side of the air compressor.

In the air compressor mentioned above, the first valve body and the second valve body may be integrated in one body. In addition, the capacity adjusting apparatus may comprise the integral shaft having the integrated valve body mounted on one end side thereof and a piston mounted on the other end side thereof, the piston may constitute a hydraulic piston portion together with a casing accommodating the piston, and an atmospheric releasing portion may be provided between the hydraulic piston portion and the intake passage. Further, the hydraulic piston portion, the atmospheric releasing portion, the intake passage and the discharge ventilating passage may be arranged in order; and an air take-in passage may be provided between the intake passage and the discharge ventilating passage. Alternatively, the air compressor may be a screw compressor comprising a pair or two pairs of female and male rotors.

A description of an embodiment of the present invention will be given below with reference to the accompanying drawings.

DETAILED DESCRIPTION OF THE INVENTION

Figure 1:
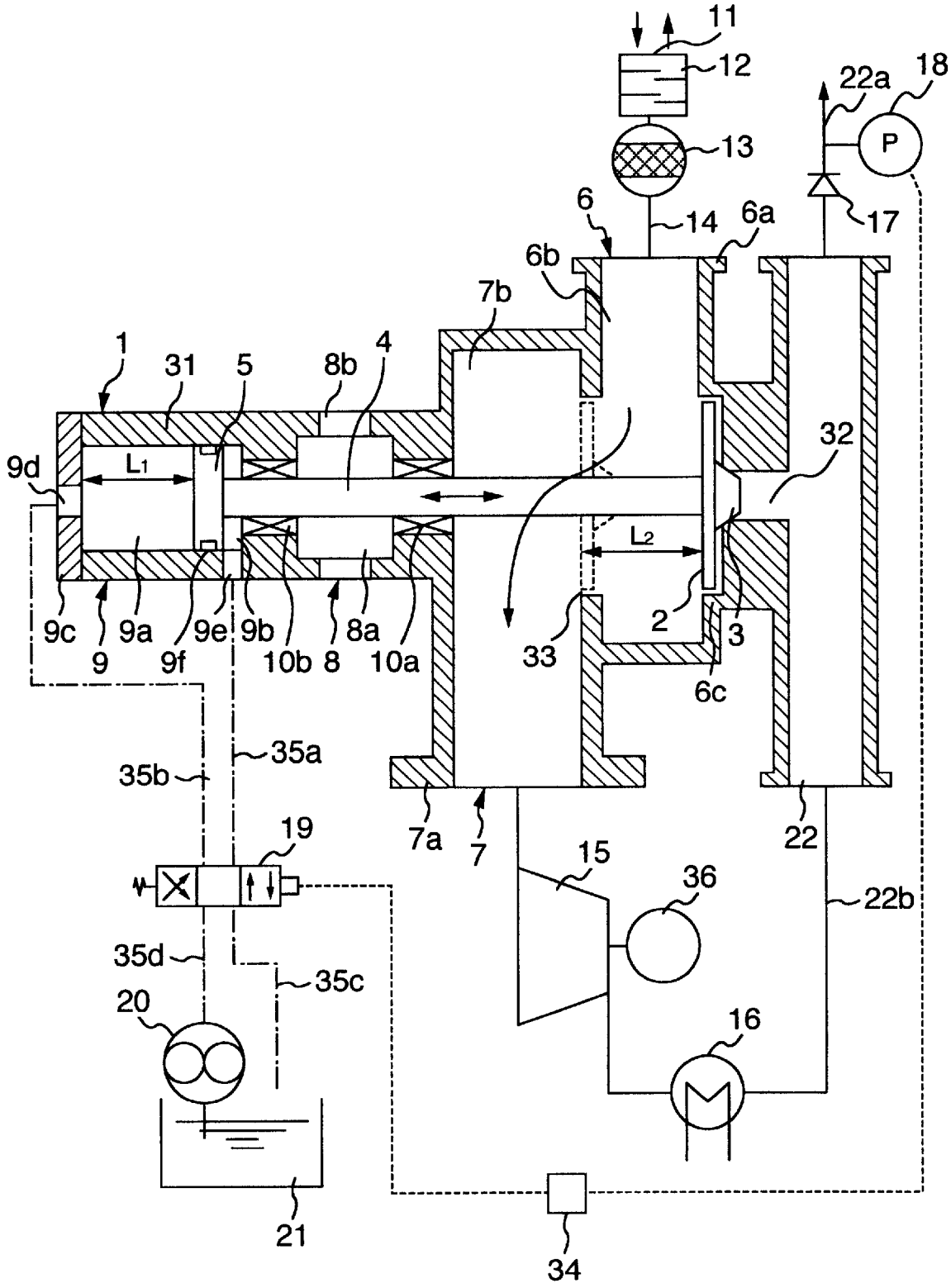
FIG. 1 is a systematic view of an embodiment of a compressor in accordance with the present invention, and shows a state in a load operation.

FIG. 1 is a view showing a summary of the flow of an air system and a capacity adjusting apparatus in an oil-free screw compressor of a single stage. An oil-free screw compressor main body 15 in accordance with the present embodiment is structured such that a male rotor and a female rotor (not shown) are engaged with each other. When an electric motor 36 is rotated by means of an inverter (not shown), and the compressor main body 15 connected to the electric motor compresses air sucked from an intake side, and discharges it as high pressure air. Although the present embodiment describes the oil-free screw compressor of a single stage, the following description may be applied to a two-stage oil-free screw compressor comprising two pairs of male and female rotors.

In the oil-free screw compressor, peripheral air of the compressor is taken from an air take-in port 11 and passes through a silencer device 12, an intake filter 13 and an intake pipe 14 in this order so that the air is introduced to a capacity adjusting apparatus 1 provided on an intake side of the compressor main body 15. In the capacity adjusting apparatus 1, a hydraulic piston portion 9, an atmospheric releasing portion 8, a compressor intake port communicating portion 7, an air take-in port communicating portion 6 and an air discharge port communicating portion 32 are arranged in this order from the left side to the right side in FIGS. 1 and 2. The hydraulic piston portion 9 comprises a casing 31, a plate member 9*c* which covers the casing 31 and is provided with an opening 9*d*, and a hydraulic piston 5 disposed within a space 9*a* formed by the plate member 9*c* and the casing 31.

The hydraulic piston 5 is connected to one end of a reciprocating shaft 4 mentioned below, and slides along an inner wall surface of the casing 31 when the shaft 4 reciprocates. In order to part the left and right spaces 9*a*, 9*b* during the slide of the piston, a piston ring 9*f* is mounted to an outer peripheral portion of the hydraulic piston 5. An opening 9*e* is formed in the right space 9*b*, and a pipe 35*a* is connected to the opening 9*e* portion for supplying a working oil from an oil tank 21 or returning the working oil to the oil tank 21. Further, a pipe 35*b* is connected to the opening 9*d* portion for supplying the working oil to the left space 9*a* or returning the working oil to the oil tank 21.

The atmospheric releasing portion 8 is formed on the right side of the hydraulic piston portion 9. The atmospheric releasing portion 8 includes a space 8*a*, bearings 10*a* and 10*b* which are held in the casing 31 and arranged in both sides of the space 8*a* so as to perform a shaft sealing function, the casing 31 surrounding those bearings, and the shaft 4 reciprocating along the inner peripheral surfaces of the bearings 10*a* and 10*b*. Further, a plurality of openings 8*b* communicating with the atmosphere are formed in the corresponding portion of the casing 31 to the space 8*a*.

The compressor intake port communicating portion 7 connected to the compressor main body 15 by means of a flange 7*a* is arranged on the right side of the atmospheric releasing portion 8, and the air take-in port communicating portion 6 connected to the intake pipe 14 by means of a flange 6*a* is further arranged in the right side of the compressor intake port communicating portion 7. The compressor intake port communicating portion 7 and the air take-in port communicating portion 6 communicate with each other through an opening portion 33, so that the intake air flowing from the flange 6*a* side is introduced from a space 6*b* of the air take-in port communicating portion 6 to a space 7*b* of the compressor intake port communicating portion 7 through the opening portion 33.

A discharge air flow passage 22 through which the compressed air flows from the compressor main body 15 is further arranged in the right side of the air take-in port communicating portion 6. In the present embodiment, the air take-in port communicating portion 6 and the discharge air flow passage 22 are integrated in one body, and the air discharge port communicating portion 32 and a receiving portion 6*c* are formed therebetween for receiving the intake port switch valve 2. The discharge ventilating port switch valve 3 and the intake port switch valve 2 are successively mounted to an end of the reciprocating shaft 4 opposite to the hydraulic piston mounting end and arranged in this order from the end side. The hydraulic piston 5, the shaft 4, the intake port switch valve 2 and the discharge ventilating port switch valve 3 constitute a part of the opening and closing means.

In this case, a diameter of the intake port switch valve 2 is bigger than that of the discharge ventilating port switch valve 3, or an area in the radial direction of the intake port switch valve 2 is larger than that of the discharge ventilating port switch valve 3. Further, the periphery of the discharge ventilating port switch valve 3 is formed in a taper shape so that the outer diameter is reduced as is close to the shaft end. On the contrary, a shape of the casing 31 on the side of the air take-in port communicating portion 6 in the air discharge port communicating portion 32 is formed in a taper shape having substantially the same incline as that of the taper of the discharge ventilating port switch valve 3. Then, the inner diameter of the receiving portion 6*c* is slightly larger than the outer diameter of the intake port switch valve 2. In this case, the outer diameter of the intake port switch valve 2 is slightly smaller than the inner diameter of the opening 33.

The compressed gas output from the compressor main body 15 is cooled by a cooler 16, and thereafter is introduced into the discharge air flow passage 22 through a pipe 22*a*. Then, the compressed gas is introduced to a discharge pipe 22*a* connected to a demand section (not shown) through a check valve 17. A pressure sensor 18 is mounted to the discharge pipe 22*a*, so that the pressure in a downstream side of the compressor main body 15 is measured. A pressure signal on the discharge side of the compressor main body 15 is measured by the pressure sensor 18 and transferred to a control unit 34 for the use to switch an electromagnetic valve 19 which controls the hydraulic piston 5.

The electromagnetic valve 19 controls the flow rate of oil in both of the pipe 35*b* supplying oil to the space 9*a* in the left side of the hydraulic piston portion 9 and the pipe 35*a* supplying oil to the space 9*b* in the right side of the hydraulic piston portion 9. An oil pump 20 is interposed in a pipe 25*d* which connects the oil tank 21 with the electromagnetic valve 19, whereby the oil in the oil tank 21 is supplied to the space 9*a* in the left side of the hydraulic piston portion 9. Another pipe 35*c* is mounted to a portion between the oil tank 21 and the electromagnetic valve 19 and exclusively used for discharging the oil as mentioned below.

The electromagnetic valve 19 is structured so as to change a direction of the oil pressure generated by the oil pump 20. That is, by switching a circuit within the electromagnetic valve 19, the hydraulic force generated in the oil pump 20 is applied to the pipe 35*a* side for example. At this time, the oil pressure of the space 9*b* in the right side of the hydraulic piston portion 9 becomes high. On the contrary, the space 9*a* in the left side of the hydraulic piston portion 9 is communicated with the pipe 35*c* by switching the circuit within the electromagnetic valve 19, so that the space 9*a* is substantially under the atmospheric pressure. As a result, the pressure within the space 9*b* becomes higher than the pressure within the space 9*a,* and the hydraulic piston 5 moves to the left side. In the same manner, when the pipe 35*b* communicates with the hydraulic pump by switching the circuit within the electromagnetic valve 19, and the pipe 35*a* is connected to the pipe 35*c* for discharging the oil, the pressure in the left space 9*a* becomes higher than the pressure in the right space 9*b,* and the hydraulic piston 5 moves to the right side.

Next, a description concerning a load operation and a no-load operation of the screw compressor in the present embodiment mentioned above will be given. When the compressor begins to start, or in the case that the demand on the load side is big, the compressor will be in a load operation state. A description is given by exemplifying a motion at a time when the demand on the load side is increased and the operation is switched from the no-load operation to the load operation.

In this case, when the pressure detected by the pressure sensor 18 for detecting the pressure on the load side becomes the previously set lower limit pressure at which the operation is switched, the control apparatus 34 transmits a command to the electromagnetic valve 19 for changing the circuit within the electromagnetic valve 19, as follows. That is, the control apparatus 34 outputs the command for communicating the pipe 35*b* with the pipe 35*d* and communicating the pipe 35*a* with the pipe 35*c*. As a result, the pressure within the space 9*a* of the hydraulic piston portion 9 becomes higher than the pressure within the space 9*b,* and the hydraulic piston 5 moves to the right side as shown in FIG. 1. When the hydraulic piston 5 moves to the right side, the shaft 4 on which the hydraulic piston 5 is mounted, and the intake port switch valve 2 and the discharge ventilating port switch valve 3 which are provided in the end portion of the shaft 4 also move to the right side. In this case, the oil pressure applied to the hydraulic piston 5 is sufficient to stand up to the pressure of the discharge air applied to the discharge ventilating port switch valve 3 closing the air discharge port communicating portion 32.

When the shaft 4 further moves, and a moving stroke of the shaft 4 reaches a value L2, the taper portion formed in the air take-in port communicating portion 6 in the air discharge port communicating portion 32 and the taper portion in the discharge ventilating port switch valve 3 are contact with each other so as to completely part the air take-in port communicating portion 6 corresponding to the intake side flow passage of the compressor main body 15 from the discharge air passage 22 corresponding to the discharge side flow passage of the compressor main body 15.

Since the discharge ventilating port switch valve 3 is accommodated in the receiving portion 6*c* provided in the portion between the air take-in port communicating portion 6 and the discharge air flow passage 22 portion at this time, there is no risk that the stream of the intake air sucked from the air take-in port communicating portion 6 is obstructed, so that the intake air is smoothly introduced from the opening 33 to the compressor main body 15 through the compressor intake port communicating portion 7. On the contrary, since the air discharge port communicating portion 32 is closed by the discharge ventilating port switch valve 3, so that the compressed air discharged from the compressor main body 15 does not flow into the intake side of the compressor main body 15 after flowing into the discharge air flow passage 22, and the compressed air is supplied to the demand section from the discharge pipe 22.

Figure 2:
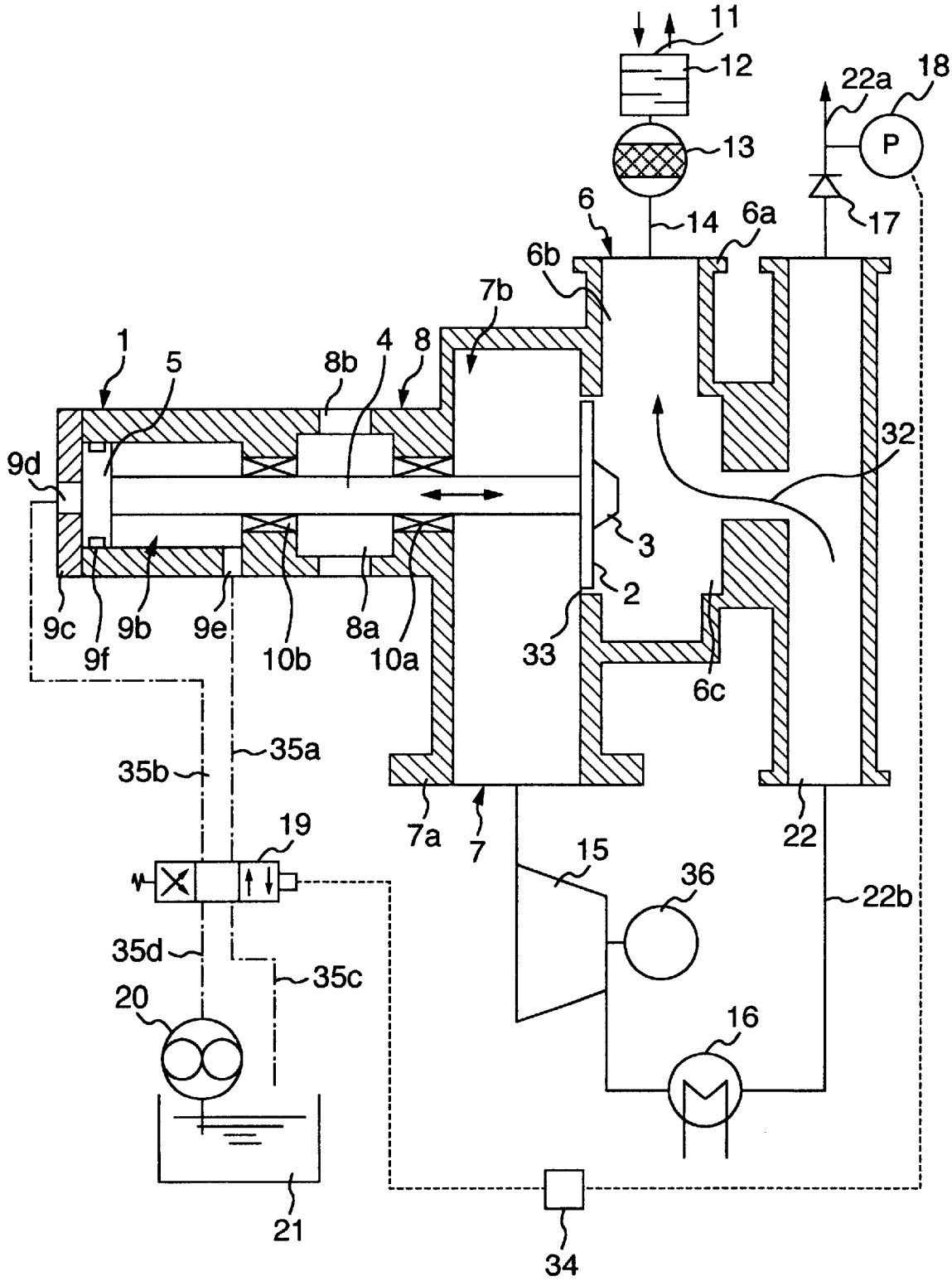
FIG. 2 is a systematic view of the embodiment, and shows a state in a no-load operation.

When the consumption of the compressed air in the demand section is reduced, so that the pressure detected by the pressure sensor 18 is increased to a upper limit setting pressure, the inverter reduces the rotation of the electric motor 36. When the pressure detected by the pressure sensor 18 is above the upper limit setting pressure yet after the rotational speed of the electric motor 36 reaches the lower limit setting value, the control unit 34 switches the circuit in the electromagnetic valve 19 so as to switch the operation to the no-load operation. This state is shown in FIG. 2 which is a similar drawing to FIG. 1 and is a view showing the no-load operation state.

By switching the circuit in the electromagnetic valve 19, the pipe 35*b* communicated with the space 9*a* in the left side of the hydraulic piston portion 9 is communicated with the pipe 35*c,* namely communicated with the oil discharging side. On the contrary, the pipe 35*a* communicated with the right space 9*b* is communicated with the pipe 35*d* in the side of the oil pump 20. As a result, the pressure in the right space 9*a* becomes higher than the pressure in the left space 9*b,* and the hydraulic piston 5, the shaft 4 connected to the hydraulic piston 5, the intake port switch valve 2 provided in the end portion of the shaft 4 and the discharge ventilating port switch valve 3 all move to the left side. When the amount of the stroke becomes the value L2, the hydraulic piston 5 stops. In this case, the moving amount of the hydraulic piston may be set so as to be equal to the distance L2 of the left space 9*a* to the inner wall surface of the plate member 9*c*. In this case, it is desirable to make the stroke L1 equal to the distance L2.

When the shaft 4 moves to the left limit, a gap is generated between the shaft 4 and the discharge ventilating port switch valve 3 closing the air discharge port communicating portion 32, and the high pressure discharge gas output from the compressor main body 15 flows to the air take-in port communicating portion 6 corresponding to the pressure lower side through the gap. On the contrary, since the opening 33 provided in the boundary between the air take-in port communicating portion 6 and the compressor intake port communicating portion 7 is substantially shut by the intake port switch valve 2, so that only a little amount of air flows to the intake side of the compressor main body 15. When the pressure in the intake side of the compressor main body 15 becomes too low, a pressure ratio of the compressor becomes increased and there is generated a risk that a temperature of the discharge air is abnormally increased, however, a little amount of air stream to the compressor main body side can prevent the matter mentioned above. In this case, when a slight gap is provided in the portion between the intake port switch valve 2 and the opening 33, there can be obtained an effect that a friction resistance and an abrasion of the intake port switch valve are prevented.

Most of the discharge air flowing into the air take-in port communicating portion 6 and discharged from the compressor main body 15 flows to the intake pipe 14, the intake filter 13 and the silencer 12 in this order, namely flows in an opposite direction to the intake air of the load operation, and is thereafter discharged to the atmospheric air from the air take-in port 11. As mentioned above, since the air in the opposite directions flows through the intake filter 13 at a time of the load operation and the no-load operation, there can be also obtained an effect of cleaning the filter at a time of flowing in the opposite directions. Further, it is possible to reduce a sound at a time of discharging by means of the silencer 12, and the silencer can be commonly used for sucking and discharging.

In this case, in the no-load operation, the oil pressure is applied to the right side of the hydraulic piston 5 in the hydraulic piston portion 9, and the compressor intake port communicating portion 7 becomes in a vacuum state. However, in accordance with the present embodiment, since the atmospheric releasing portion 8 is provided in the portion between the hydraulic piston portion and the compressor intake port communicating portion, it is possible to reduce a pressure difference applied to the shaft sealing portion which is configured by the bearing. Further, since the oil is discharged to the atmospheric air side from the opening provided in the atmospheric releasing portion even if the oil should be leaked out to the atmospheric releasing portion from the hydraulic piston portion, it is possible to prevent the oil from flowing into the compressor 15 and polluting the discharge air. Since the oil discharged to the atmospheric air side is of course recovered by an oil recovery apparatus (not shown), there is no risk that the oil pollute the environment.

As mentioned above, according to the present embodiment, it is possible to omit the ventilating pipe and the silencer, so that the number of parts in the capacity adjusting apparatus is reduced. As a result, it is possible to provide a capacity adjusting apparatus of which the cost is reduced and the reliability is improved.

In case of the above embodiment, although the hydraulic piston portion, the atmospheric releasing portion, the compressor intake port communicating portion, the air take-in port communicating portion and the air discharge passage portion pipe are integrated in one body, it is also possible to form those into respective flange structures or the like, so that the respective ones are integrated by screwing. Further, the hydraulic piston portion and the atmospheric releasing portion, and the compressor intake port communicating portion and the air take-in port communicating portion may be integrated respectively, and thereafter the respective ones are integrated together with the air discharge passage portion pipe by means of a bolt, a welding, or the like. According to these methods, it is possible to separate the complex structure into respective parts so as to obtain the effect that the working man-hour is reduced entirely.

Further, although the capacity adjusting apparatus is provided with all of the hydraulic piston portion, the atmospheric releasing portion, the compressor intake port communicating portion, the air take-in port communicating portion, and the air discharge passage portion pipe in the above embodiment, these portions or parts may not provided in the capacity adjusting apparatus, and thus, the air compressor in which the atmospheric air intake in the load operation and the air discharge in the no-load operation are switched by reciprocating a shaft belongs to the scope of the invention.

Further, although the compressor main body is rotated by means of the inverter driven electric motor in the above embodiment, the present invention can be applied to the case that the electric motor is not provided with an inverter. In this case, it is possible to provide the compressor more inexpensive.

Moreover, according to the present embodiment, since it is unnecessary to provide the ventilating pipe and the ventilating silencer, the cost of the compressor is reduced. Further, since the compressor intake port is not invaded by oil, it is possible to provide a good quality air. Furthermore, since the portions of the capacity adjusting apparatus are effectively arranged therein, there can be obtained the effects that the capacity adjusting apparatus becomes compact and light.

According to the present invention, the atmospheric air intake under the load operation and the air discharge under the no-load operation are switched only by reciprocating valves provided on a shaft. Accordingly, it is possible to reduce the number of parts in the compressor apparatus and to provide the compressor which is inexpensive and has a high reliability.

What is claimed is:

1. An air compressor comprising a compressor and a capacity adjusting apparatus provided on an intake side thereof, which repeats a load operation and a no-load operation, the capacity adjusting apparatus being provided with an intake port and a discharge ventilating port aligned with one another, the intake port being opened during the load operation and closed during the no-load operation, the discharge ventilating port being closed during the load operation and opened during the no-load operation, wherein said capacity adjusting apparatus comprises a compressor intake passage provided on an intake side of the compressor;

a discharge passage provided on a discharge side of the compressor;

an air intake communication passage having an air intake at its upstream end and being connected to the compressor intake passage at its downstream end by the intake port and being connected to the discharge passage by the discharge ventilating port; and a first valve body for opening and closing said intake port and a second valve body for opening and closing said discharge ventilating port, the first valve body and the second valve body are arranged on a integral shaft.

2. An air compressor as claimed in claim 1, wherein said first valve body and said second valve body are integrated in one body.

3. An air compressor as claimed in claim 2, wherein said capacity adjusting apparatus comprises the integral shaft having said integrated valve body mounted on one end side thereof and a piston mounted on the other end side thereof, said piston constitutes a hydraulic piston portion together with a casing accommodating the piston, and an atmospheric releasing portion is provided between the hydraulic piston portion and said intake passage.

4. An air compressor as claimed in claim 3, wherein said hydraulic piston portion, said atmospheric releasing portion, said compressor intake passage, said air intake communication passage and said discharge passage are arranged in order.

5. An air compressor as claimed in claim 1, wherein the compressor is a screw compressor comprising a pair or two pairs of female and male rotors.

6. An air compressor comprising a compressor and a capacity adjusting apparatus, the air compressor repeating a load operation and a no-load operation, the capacity adjusting apparatus comprising:

an air-intake communication pipe positioned on an intake side of the air compressor;

a discharge pipe positioned on a discharge side of the air compressor in parallel with the air-intake communication pipe, the discharge pipe being connected with the air-intake communication pipe via an air discharge port;

an air-compressor air intake pipe positioned on an intake side of the air compressor downstream of the air-intake communication pipe and in parallel with the air-intake communication pipe, the air-compressor air intake pipe being connected with the air-intake communication pipe via an opening; and a first valve body for opening and closing the opening and a second valve body for opening and closing the air discharge port, the first valve body and the second valve body being arranged on a integral shaft, wherein the integral shaft moves so that the first valve body covers the opening in the no-load operation, and that the second valve body covers the discharge port in the load operation.

7. An air compressor as claimed in claim 6, wherein the first valve body and the second valve body are formed integrally.

8. An air compressor as claimed in claim 7, wherein the integral shaft is provided with the integrated valve body on one end side thereof and a piston on the other end side thereof, and the capacity adjusting apparatus further comprises a casing for housing the piston to constitute a hydraulic piston portion for moving the integral shaft, and an atmospheric releasing portion positioned so as to separate the hydraulic piston portion from the air-intake communication pipe, the discharge pipe and the air-compressor air intake pipe.

9. An air compressor as claimed in claim 8, wherein the hydraulic piston portion, the atmospheric releasing portion, the air-compressor air intake pipe and the discharge pipe are arranged in order, and the air-intake communication pipe is provided between the air-compressor air intake pipe and the discharge pipe.

10. An air compressor as claimed in claim 6, wherein the compressor is a screw compressor comprising a pair or two pairs of female and male rotors.

* * * * *